US005937958A

United States Patent [19]

Mensa-Wilmot et al.

[11] Patent Number: 5,937,958

[45] Date of Patent: Aug. 17, 1999

[54] DRILL BITS WITH PREDICTABLE WALK TENDENCIES

[75] Inventors: Graham Mensa-Wilmot, Houston; Carl W. Keith, Spring, both of Tex.

[73] Assignee: Smith International, Inc., Houston, Tex.

[21] Appl. No.: 08/808,977

[22] Filed: Feb. 19, 1997

[51] Int. Cl.[6] ..... E21B 10/46; E21B 10/56

[52] U.S. Cl. ..... 175/398; 175/431

[58] Field of Search ..... 175/61, 376, 398, 175/431

[56] References Cited

U.S. PATENT DOCUMENTS

| | | | |
|---|---|---|---|
| 4,440,244 | 4/1984 | Wiredal | 175/292 |
| 4,982,802 | 1/1991 | Warren et al. | 175/57 |
| 5,010,789 | 4/1991 | Brett et al. | 76/108.2 |
| 5,099,929 | 3/1992 | Keith et al. | 175/61 |
| 5,109,935 | 5/1992 | Hawke | 175/434 |
| 5,119,892 | 6/1992 | Clegg et al. | 175/431 |
| 5,131,478 | 7/1992 | Brett et al. | 175/57 |
| 5,222,566 | 6/1993 | Taylor et al. | 175/431 |
| 5,238,075 | 8/1993 | Keith et al. | 175/431 |
| 5,265,685 | 11/1993 | Keith et al. | 175/431 |

FOREIGN PATENT DOCUMENTS

| | | |
|---|---|---|
| 0522553 | 1/1993 | European Pat. Off. . |
| 2246151 | 1/1992 | United Kingdom . |

*Primary Examiner*—David J. Bagnell
*Attorney, Agent, or Firm*—Conley, Rose & Tayon, P.C.

[57] ABSTRACT

A drill bit adapted to walk predictably during drilling is disclosed, comprising: a bit body having a longitudinal axis and a bit face having an active zone and a passive zone, and a plurality of cutters on the bit face, a first portion of said cutters being positioned in the active zone and a second portion of said cutters being positioned in the passive zone, the first portion of cutters being more aggressive than the second portion. This the difference in aggressiveness of cutters in the first and second portions is achieved by maximizing the effect of one or more of seven features of the bit. These features include: cutter size, cutter tip profile, blade relationship, cutting structure, back rake, gage pad design and balance. Application of the principles of the present invention result in a large imbalance vector being oriented toward the leading half of the active zone.

33 Claims, 6 Drawing Sheets

FIG. 3A

| CUT No. | CUTTER LAYOUT TABLE | | | | |
|---|---|---|---|---|---|
| | RADIUS | CUTTER HEIGHT | BR | CUTTER TYPE | BLADE |
| 1 | .399 | -2.291 | 15 | 1908F | 123 |
| 2 | .800 | -2.055 | 15 | 1908F | 121 |
| 3 | 1.145 | -1.855 | 15 | 1908F | 123 |
| 4 | 1.555 | -1.618 | 15 | 1908F | 121 |
| 5 | 1.594 | -2.116 | 35 | 1908F | 124 |
| 6 | 1.901 | -1.418 | 15 | 1908F | 123 |
| 7 | 2.132 | -1.221 | 10 | 1608F | 122 |
| 8 | 2.311 | -1.524 | 35 | 1613F | 125 |
| 9 | 2.399 | -1.130 | 15 | 1913F | 121 |
| 10 | 2.658 | -0.980 | 15 | 1913F | 123 |
| 11 | 2.890 | -0.784 | 10 | 1613F | 122 |
| 12 | 3.046 | -1.043 | 35 | 1913F | 125 |
| 13 | 3.046 | -1.043 | 35 | 1913F | 125 |
| 14 | 3.174 | -0.672 | 20 | 1913F | 121 |
| 15 | 3.446 | -0.519 | 20 | 1913F | 124 |
| 16 | 3.714 | -0.370 | 10 | 1613F | 122 |
| 17 | 3.758 | -0.513 | 35 | 1613F | 125 |
| 18 | 3.758 | -0.513 | 35 | 1613F | 125 |
| 19 | 4.017 | -0.359 | 20 | 1913F | 121 |
| 20 | 4.319 | -0.359 | 20 | 1913F | 124 |
| 21 | 4.623 | -0.356 | 20 | 1613F | 122 |
| 22 | 4.623 | -0.356 | 20 | 1613F | 125 |
| 23 | 4.623 | -0.356 | 20 | 1613F | 125 |
| 24 | 4.890 | -0.519 | 20 | 1913F | 121 |
| 25 | 5.173 | -0.679 | 25 | 1913F | 124 |
| 26 | 5.428 | -0.835 | 25 | 1613F | 122 |
| 27 | 5.428 | -0.835 | 25 | 1613F | 125 |
| 28 | 5.428 | -0.835 | 25 | 1613F | 125 |
| 29 | 5.572 | -1.114 | 25 | 1913F | 121 |
| 30 | 5.736 | -1.406 | 30 | 1913F | 124 |
| 31 | 5.862 | -1.655 | 30 | 1613F | 122 |
| 32 | 5.862 | -1.655 | 30 | 1613F | 125 |
| 33 | 5.862 | -1.655 | 30 | 1613F | 125 |
| 34 | 5.869 | -2.001 | 30 | 1913F | 121 |
| 35 | 6.062 | -2.125 | 30 | 1313F | 124 |
| 36 | 6.063 | -2.425 | 30 | 1313F | 122 |
| 37 | 6.063 | -2.425 | 30 | 1313F | 125 |
| 38 | 6.063 | -2.425 | 30 | 1313F | 125 |
| 39 | 6.063 | -2.750 | 30 | 1313F | 124 |
| 40 | 6.063 | -2.750 | 30 | 1313F | 121 |

DRILL BITS WITH PREDICTABLE WALK TENDENCIES

The present invention relates generally to drill bits and more generally to a bit designed to shift orientation of its axis incrementally as it drills. Still more particularly, the present invention comprises a drill bit having seven features that maximize its tendency to walk right as it drills and another drill bit having features that maximize its tendency to walk left as it drills.

Drill bits in general are well known in the art. In recent years a majority of bits have been designed using hard polycrystalline diamond compacts (PDC) as cutting or shearing elements. The cutting elements or cutters in turn are mounted on a rotary bit and oriented so that each PDC engages the rock face at a desired angle. The bit is attached to the lower end of the drill string and is typically rotated by rotating the drill string at the surface. The bit is typically cleaned and cooled during drilling by the flow of drilling fluid out of one or more nozzles on the bit face. The fluid is pumped down the drill string, flows across the bit face, removing cuttings and cooling the bit, and then flows back to the surface in the annulus between the drill string and the borehole wall.

The cost of drilling a borehole is proportional to the length of time it takes to drill the borehole to the desired depth and location. The drilling time, in turn, is greatly affected by the number of times the drill bit must be changed, in order to reach the targeted formation. This is the case because each time the bit is changed the entire drill string, which may be miles long, must be retrieved from the borehole section by section. Once the drill string has been retrieved and the new bit installed, the new bit must be lowered to the bottom of the borehole on the drill string, which again must be constructed section by section. This process, known as a "trip" of the drill string, requires considerable time, effort and expense. Accordingly, it is always desirable to minimize the number of trips that must be made in a given well.

In recent years, the PDC bit has become an industry standard for cutting formations of grossly varying hardnesses. The cutting elements used in such bits are formed of extremely hard materials and include a layer of polycrystalline diamond material. In the typical PDC bit, each cutter element or assembly comprises an elongate and generally cylindrical support member which is received and secured in a pocket formed in the surface of the bit body. A PDC cutter typically has thin hard cutting layer of polycrystalline diamond exposed on one end of its support member, which is typically formed of tungsten carbide.

The configuration or layout of the PDC cutters on a bit face varies widely, depending on a number of factors. One of these is the formation itself, as different cutter layouts cut the various strata differently. In running a bit, the driller may also consider weight on bit, the weight and type of drilling fluid, and the available or achievable operating regime. Additionally, a desirable characteristic of the bit is that it be "stable" and resist vibration, the most severe type or mode of which is "whirl," which is a term used to describe the phenomenon wherein a drill bit rotates at the bottom of the borehole about a rotational axis that is offset from the geometric center of the drill bit. Whirling subjects the cutting elements on the bit to increased loading, which causes the premature wearing or destruction of the cutting elements and a loss of penetration rate. It is known that an imbalanced bit will adversely affect performance, and this tendency is generally minimized by attempting to provide bits that are as close to balanced as possible. Alternatively, U.S. Pat. Nos. 5,109,935 and 5,010,789 disclose techniques for reducing whirl by compensating for imbalance in a controlled manner. In general, optimization of cutter placement and orientation and overall design of the bit have been the objectives of extensive research efforts.

Directional and horizontal drilling have also been the subject of much research. Directional and horizontal drilling involves deviation of the borehole from vertical, and frequently results in boreholes whose remote ends are approximately horizontal. Advancements in measurement while drilling (MWD) technology have made it possible to track the position and orientation of the wellbore very closely. At the same time, more extensive and more accurate information about the location of the target formation is now available to drillers as a result of improved logging techniques and methods such as geosteering. These increases in available information have raised the expectations for drilling performance. For example, a driller today may target a relatively narrow, horizontal oil-bearing stratum, and may wish to maintain the borehole within the stratum once he has entered it. In more complex scenarios, highly specialized "design drilling" techniques are preferred, resulting in a borehole that may have two or more bends lying in different planes.

A common way to control the direction in which the bit is drilling is to steer using a downhole motor with a bent sub and/or housing. As shown in FIG. 1, a simplified version of a downhole steering system according to the prior art comprises a rig 10, drill string 12, bent sub 14, motor 16 housed in bent sub 14, and drill bit 18. The motor 16 and bent housing 14 form part of the bottom hole assembly (BHA) and are attached to the lower end of the drill string 12 adjacent the bit 18. When not rotating, the bent housing causes the bit face to be canted with respect to the tool axis. The downhole motor is below the bend in the housing. The motor is capable of converting fluid pressure from fluid pumped down the drill string into rotational energy at the bit. This allows the bit to be rotated without rotating the drill string. When a downhole motor is used with a bent housing and the drill string is not rotated, the rotating action of the motor normally causes the bit to drill a hole that is deviated in the direction of the bend in the housing. When the drill string is rotated, the borehole normally maintains direction, regardless of whether a downhole motor is used, as the bent housing rotates along with the drill string and thus no longer orients the bit in a particular direction. Hence, a bent housing and downhole motor are effective for deviating a borehole.

In addition to deviating a borehole, that is, changing the angle of inclination of the bottom of the hole, it is often desired to change the azimuth of the bottom of the hole. Changing the orientation of the hole bottom in this manner is commonly referred to as "walking," and more particularly as "right walking" and "left walking."

When a well is substantially deviated by several degrees from vertical, such as by more than 30 degrees, the factors influencing drilling and steering are different. The weight on bit (WOB) significantly affects the force with which the cutters engage the rock at the hole bottom. As the deviated hole approaches horizontal, it becomes much more difficult to apply a useful WOB, as the well bottom is no longer aligned with the gravitational force. Furthermore, the increasing bend in the drill string means that downward force applied to the string at the surface is less likely to be translated into WOB, and is more likely to cause buckling of the drill string. Attempting to steer with a downhole motor and a bent sub normally reduces the achievable rate of penetration (ROP) of the operation.

First, using the motor to change the azimuth of the bit without rotating the drill string, a process commonly referred to as "sliding," means that the drilling fluid in most of the length of the annulus is not subject to the rotational shear that it would experience if the drill string were rotating. Drilling fluids tend to be thixotropic, so the loss of this shear adversely affects the ability of the fluid to carry cuttings out of the hole. Thus, in deviated holes that are being drilled with the downhole motor alone, cuttings tend to settle on the bottom or low side of the hole.

Second, drilling with the downhole motor alone during sliding deprives the driller of the advantage of a significant source of rotational energy, namely the surface equipment that would otherwise rotate the drill string. This surface rotation equipment is disconnected from the drill string during steered drilling using a downhole motor. Additionally, drilling with the motor alone means that a large fraction of the fluid energy is consumed in the form of a pressure drop across the motor in order to provide the rotational energy that would otherwise be provided by equipment at the surface. Thus, when surface equipment is used to rotate the drill string and the bit, significantly more power is available downhole and drilling is faster. This power can be used to rotate the bit or to provide more hydraulic energy at the bit nozzles, for better cleaning and faster drilling.

For all of these reasons, it is desired to eliminate the sliding process from a directional or horizontal drilling process, by providing a device for altering the azimuthal direction of a well without using a downhole motor with a bent housing. It is further desired to provide a device that allows simultaneous walking of the bit and building the angle of deviation. It is further desired to alter the direction of a well in a controlled manner, and to do so while drilling.

SUMMARY OF THE INVENTION

Accordingly, there is provided herein a bit that alters the direction of a well without using a downhole motor with a bent housing. The present bit also alters the direction of a well in a controlled manner, and does so while drilling.

The bit generally includes a bit body and a cutting face which includes a plurality of sets of cutter elements mounted on the bit face. The face of the present bit is divided into an active zone and a passive zone. The active zone engages the well bottom aggressively, while the passive zone engages to an extent that is dependent on the formation type, hardness and the drilling operation's desired walk rate. In the present bit, a large imbalance vector is oriented toward the leading half of the active zone. This is accomplished by maximizing the effect of one or more of seven features of the bit. These features include: cutter size, cutter tip profile, blade relationship, cutting structure, back rake, gage pad design and balance. More specifically, the present bit includes cutters in its active zone that are generally larger than the cutters in its passive zone, a primary cutter tip profile in the active zone that is more aggressive than the secondary cutter tip profile in the passive zone, a cutting structure that emphasizes the aggressiveness of the active zone, back rake on cutters in the active zone that is more aggressive than the back rake on cutters in the passive zone, and gage pad design and imbalance vectors that complement the configuration of the passive and active zones.

BRIEF DESCRIPTION OF THE DRAWINGS

For a detailed description of the preferred embodiment of the invention, reference will now be made to the accompanying drawings, wherein:

FIG. 3A is a Table showing the size, radial position, cutting structure, back rake and longitudinal positions of the cutters in the bit of FIG. 2;

DETAILED DESCRIPTION OF A PREFERRED EMBODIMENT

Figure 2:
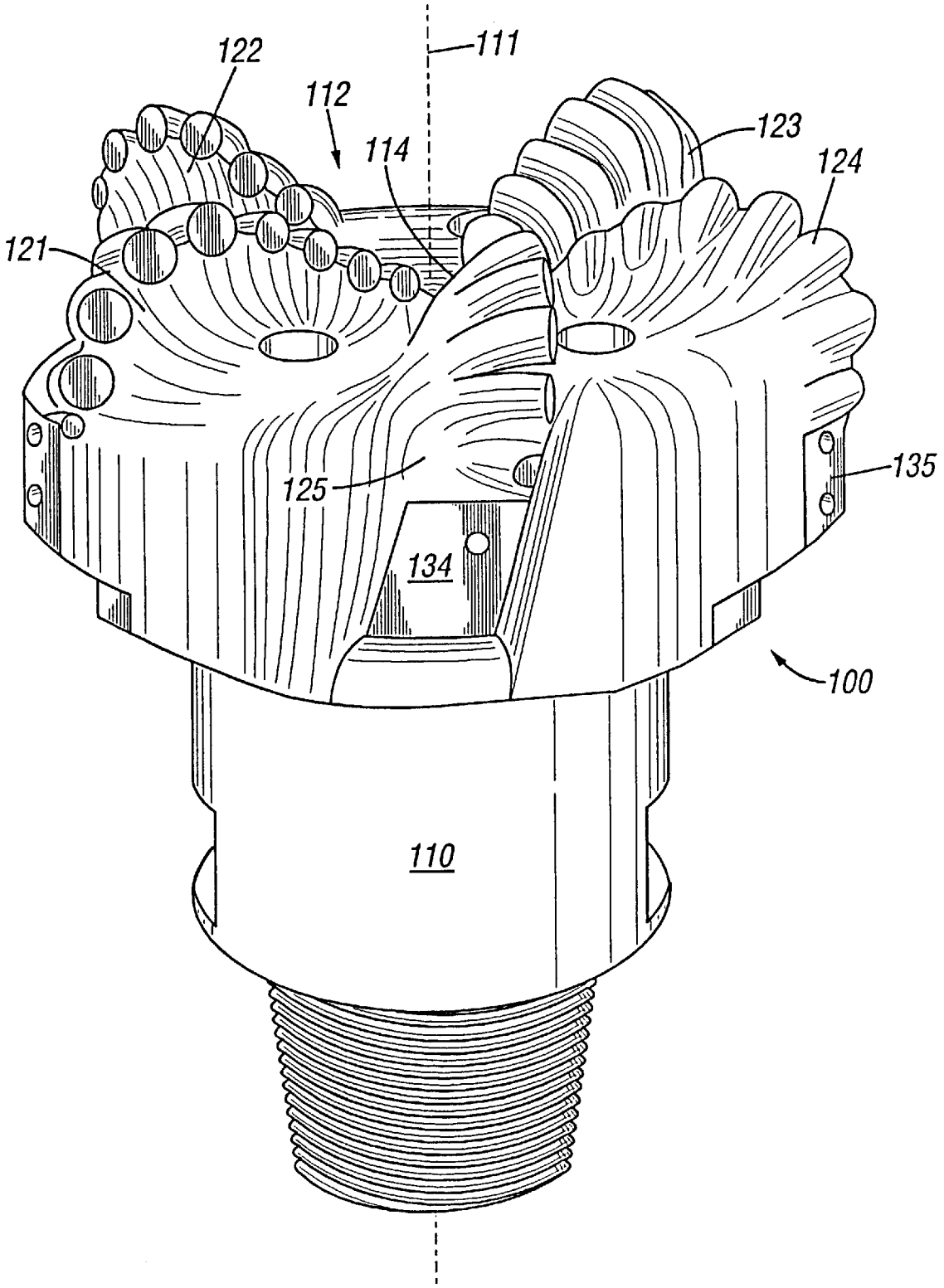
FIG. 2 is a perspective view of a drill bit constructed in accordance with the principles of the present invention.
Figure 3:
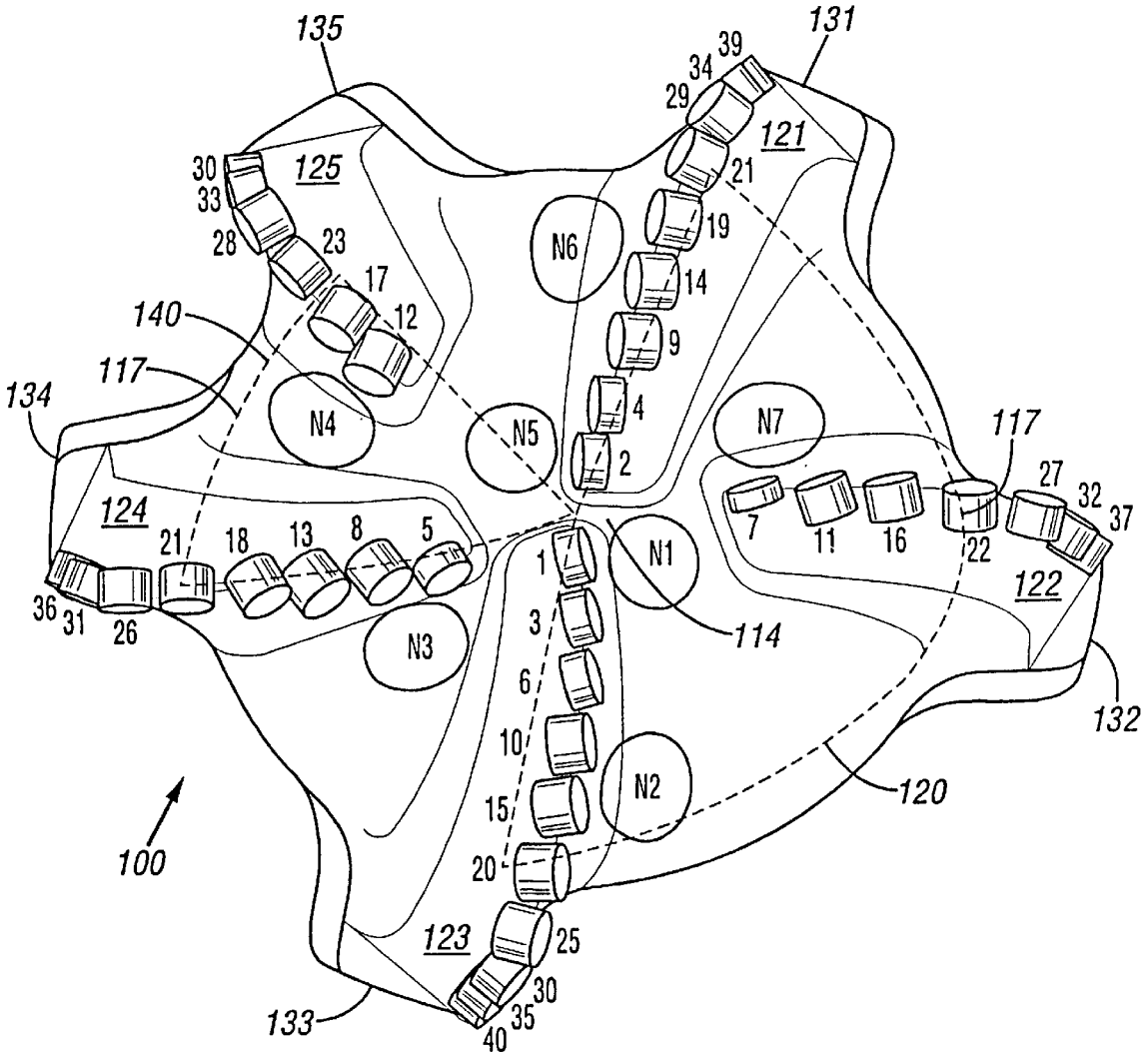
FIG. 3 is a bottom view of the bit of FIG. 2 marked with sequential numbers showing the cutter order.

Referring initially to FIGS. 2 and 3, a PDC bit 100 typically comprises a generally cylindrical, one-piece body 110 having a longitudinal axis 111 and a conical cutting face 112 at one end. Face 112 includes a plurality of blades 121, 122, 123, 124 and 125 extending generally radially from the center of the cutting face 112. Each blade supports a plurality of PDC cutter elements as discussed in detail below. As best shown in FIG. 4, cutting face 112 has a central depression 114, a gage portion 116 and a shoulder 115 therebetween. The highest point (as drawn) on the cutter tip profiles defines the bit nose 117. This general configuration is well known in the art. Nevertheless, applicants have discovered that the walking tendencies of the bit can be enhanced and that a bit that walks predictably and precisely can be constructed by implementing several novel concepts. These novel concepts are set out in no particular order below and can generally be implemented independently of each other, although it is preferred that at least three be implemented simultaneously in order to achieve more satisfactory results.

A preferred embodiment of the present invention entails simultaneous implementation of all of the concepts described in detail below. The bit shown in FIGS. 2 and 3 is a 12¼ inch bit. It will be understood that the dimensions of various elements described below correspond to this 12¼ inch bit and that bits of other sizes can be constructed according to the same principles using components of different sizes to achieve similar results.

Active and Passive Zones

Referring again to FIGS. 2 and 3, the cutting face 112 of a bit constructed in accordance with the present invention includes an active zone 120 and a passive zone 140. Active zone 120 is a generally semi-circular zone defined herein as the portion of the bit face lying within the radius of nose 117 and extending from blade 121 to blade 123 and including the cutters of blades 121, 122 and 123. According to a preferred embodiment, active zone 120 spans approximately 120–180 degrees and preferably approximately 160 degrees. Passive zone 140 is a generally semi-circular zone defined herein as the portion of the bit face lying within the radius of nose 117 and extending from blade 124 to blade 125 and including the cutters of blades 124 and 125. According to a preferred embodiment, passive zone 140 spans approximately 50–90 degrees and preferably approximately 60 degrees.

Primary and Secondary Cutter Tip Profiles

Referring now to FIG. 4, a primary cutter tip profile p that is used in the active zone and a secondary cutter tip profile s that is used in the passive zone are superimposed on one another. While the gage portions 116 of the two blades have similar profiles up to the bit nose 117, the secondary profile s drops away from the bit nose 117 more steeply toward the center of face 112 than does the primary profile p. According to a preferred embodiment, the tips of the cutters on blades 124 and 125 lying between the bit's central axis 111 and its nose 117 are located on the secondary profile s while the tips of the cutters on blades 121, 122, and 123 lying between the bit's central axis 111 and its nose 117 are located on the primary profile p.

In general, this difference in profiles means that cutters toward the center of face 112 in passive zone 140 will contact the bottom of the borehole to a reduced extent and the cutting will be performed predominantly by cutters on the primary profile, on blades 121, 123. For this reason, the forces on cutters on the primary profile lying in the active zone are greater than the forces on cutters on the secondary profile lying in the passive zone. Likewise, the torque generated by the cutters on the primary profile that lie in the active zone is greater than the torque generated by the cutters on the secondary profile that lie in the passive zone. The two conditions described above, coupled with the fact that the torque on the portion of the bit face that lies within the radius of nose 117 is greater than the torque generated in the shoulder and gage portions of cutting surface 112, tend to cause the bit to walk right. The degree to which walking occurs depends on the degree of difference between the primary and secondary profiles. As the secondary profile becomes more steep, the walk tendency increase. In many instances it will be desirable to provide a secondary profile that is not overly steep, so as to provide a bit that walks slowly and in a controlled manner.

Figure 4A:
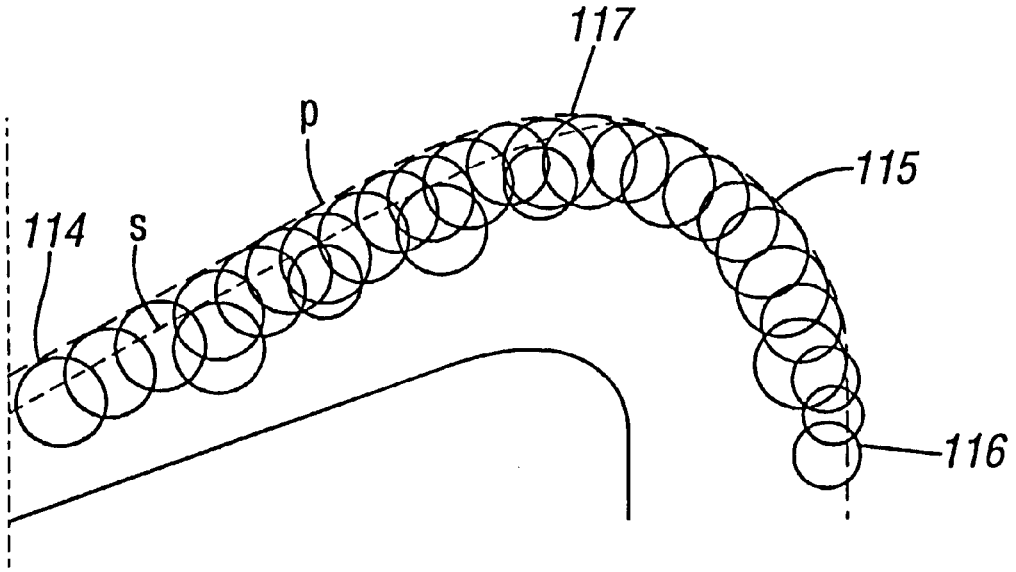
FIG. 4A is a schematic view showing an alternative embodiment of the concept illustrated in FIG. 4.
Figure 4:
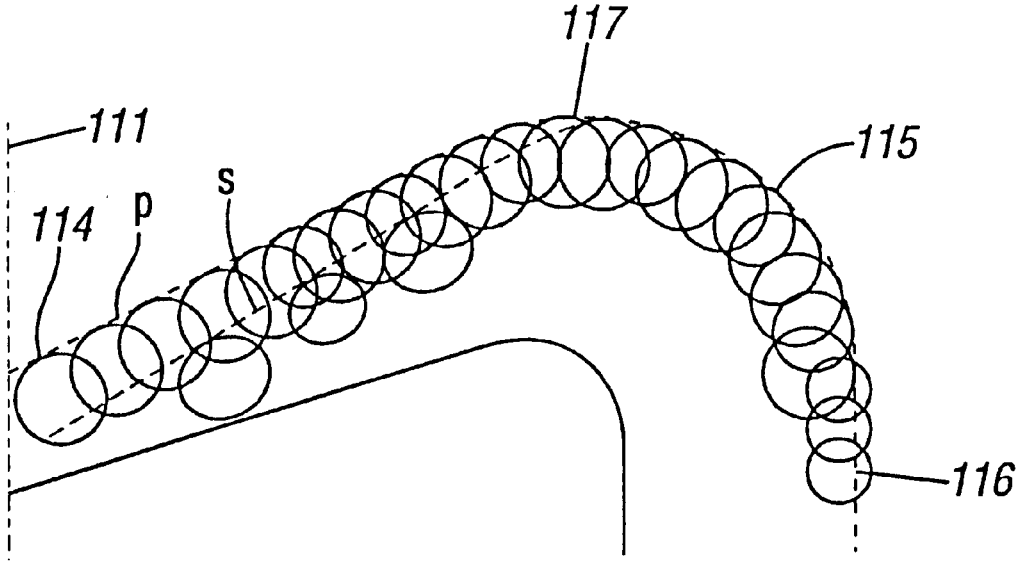
FIG. 4 is a schematic view showing the cutters on the bit shown in FIG. 2 rotated into a single plane.

In an alternative embodiment shown in FIG. 4A, the secondary cutter tip profile s can be parallel to but offset from the primary cutter tip profile p. The net effect on the torque distribution and resultant walking tendencies is comparable to that of the previous embodiment.

Cutter Size

As shown and preferred, at least two sizes of cutter are mounted on cutting face 112, with the cutters on blades 121 and 123 being generally larger than those on blades 122, 124 and 125. For example, referring briefly to FIG. 3A, cutters 1, 2, 3, 4, and 6 are size 1908 (having a diameter of 19 mm and a substrate or cylinder length of 8 mm) and cutters 9, 10, 12–15, 19–20, 24–25 and 29–30 are size 1913, while cutters 7, 8, 11, 16–18, 21–23, and 26–28 are size 1613 or smaller. Altogether, only three large cutters, (numbers 5, 12, and 13) are on blades other than 121 or 123. Similarly, with the exception of cutters 5, 12 and 13, all of the cutters on blades 122, 124 and 125 are smaller than those on blades 121 and 123. As known to those skilled in the art, larger diameter cutters are more aggressive than smaller diameter cutters.

Cutting Structure

Referring again to FIG. 3A, the radial position of each cutter is shown. It will be seen that certain cutters occupy radial positions that are identical to other cutters. The term "redundant" is used hereinafter to refer to cutters that cut essentially the same trough. The term "dominant" is used to refer to a redundant cutter that cuts more aggressively than the other cutter(s) occupying the same radius. According to a preferred embodiment of the present invention, redundant cutters are located at on blades 124, 125, and 122. Relating back to the discussion of cutter size above, it is preferred that in each set of redundant cutters, one of the cutters be larger than the other cutters at that radius. Similarly it is contemplated but not preferred that one or more of the innermost cutters closest to the bit axis in the blades with redundant cutters be larger than the other cutters on the same blade. Furthermore, it is preferred that this larger cutter be located on the redundant blade in the active zone and that the smaller cutters be generally located in the passive zone. Thus, in the bit shown in FIGS. 2 and 3, blades 124 and 125 support non-dominant redundant cutters. In a preferred embodiment, blade 122 supports cutters that are redundant with and dominant to the cutters on blades 124 and 125, so that the force and torque generated by the blades on the secondary profile that lie in the passive zone is reduced.

Blade Relationship

Referring again to FIG. 3, another factor that influences the bit's tendency to walk is the relationship of the blades and the manner in which they are arranged on the bit face. Specifically, the angles between adjacent pairs of blades and the angles between blades having cutters in redundant positions affects the relative aggressiveness of the active and passive zones and hence the torque distribution on the bit. To facilitate the following discussion, the blade position is used herein to mean the position of a radius drawn through the last or outermost non-gage cutter on a blade. According to the preferred embodiment shown in the Figures, the most important angles are those between blades 121 and 123 and between blades 124 and 125. These are preferably approximately 180 degrees and 60 degrees, respectively. As the angle between blades on the secondary profile (124 and 125) decreases, the loading and torque generated by the redundant member, blade 122 increases to intensify the aggressiveness of the active zone. According to a preferred embodiment, the blades in the passive zone, having redundant cutters, are no more than 60 degrees apart. Also, the larger the angle between the leading and trailing blades in the active zone, lying on the primary profile, the greater the angular spread of the torque generated by the active side of the bit. This property enhances the mechanism required to make the bit walk right.

Aggressive Back Rake on Cutters in the Active Zone

Referring again to FIG. 3A, in general the back rake on cutters in the active zone is less than the back rake on cutters in the passive zone. As is standard in the art, Backrake may generally be defined as the angle formed between the cutting face of the cutter element and a line that is normal to the formation material being cut. Thus, with a cutter element having zero backrake, the cutting face is substantially perpendicular or normal to the formation material. Similarly, the greater the degree of back rake, the more inclined the cutter face is and therefore the less aggressive it is. According to a preferred embodiment, the average back rake on cutters in the active zone is 15 degrees, while the average back rake on cutters in the passive zone is 30 degrees. Increasing back rake on cutters in the passive zone relative to the back rake in the active zone in this manner establishes a more unequal distribution of torque on the bit face and increases its tendency to walk right as described herein.

Gage Pad Design

Still referring to FIG. 3, the gage pad 131, 132 133, 134 and 135 of each blade 121, 122, 123, 124 and 125 respectively has a radius r measured from the longitudinal axis of the bit. According to the present invention, the radii $r_{124}$ and $r_{125}$ of the gage pads of blades 124 and 125 are slightly less than the radii $r_{121}$, $r_{122}$ and $r_{123}$ of the gage pads of blades 121, 122 and 123. The difference between $r_{124}$–$r_{125}$ and $r_{121}$–$r_{123}$ is preferably approximately 0.125 inch. This difference in gage pad radius causes blades 121, 122, and 123 to shift toward the right and low side of a deviated borehole when blades 124 and 125 are on the high side of the hole.

This difference reduces the friction with which blades 124 and 125 normally resist the aggressiveness of blades 121, 122, and 123 once they start initiating the bit's walking tendency and shift to the right and low side of the hole. This generally increases the tendency of the bit to walk right.

Imbalance Vectors

In addition to the foregoing factors, the present bit preferably has an imbalance vector that has a magnitude of approximately 10 to 25 percent and more preferably at least 15 percent of its weight on bit, depending on its size. The imbalance force preferably lies in active zone 120 and more preferably in the leading half of active zone 120. Still more preferably, the imbalance force is oriented as closely as possible to the leading edge of active zone 120 (blade 121). The tendency of the present bit to walk increases as the magnitude of the imbalance force increases. Similarly, the tendency of the present bit to walk increases as the imbalance force approaches leading blade 121. The magnitude of the imbalance vector can be increased by manipulating the geometric parameters that define the positions of the PDC cutters on the bit, such as back rake, side rake, height, angular position and profile angle. Likewise, the required direction of the imbalance force can be achieved by manipulation of the same parameters.

Figure 1:
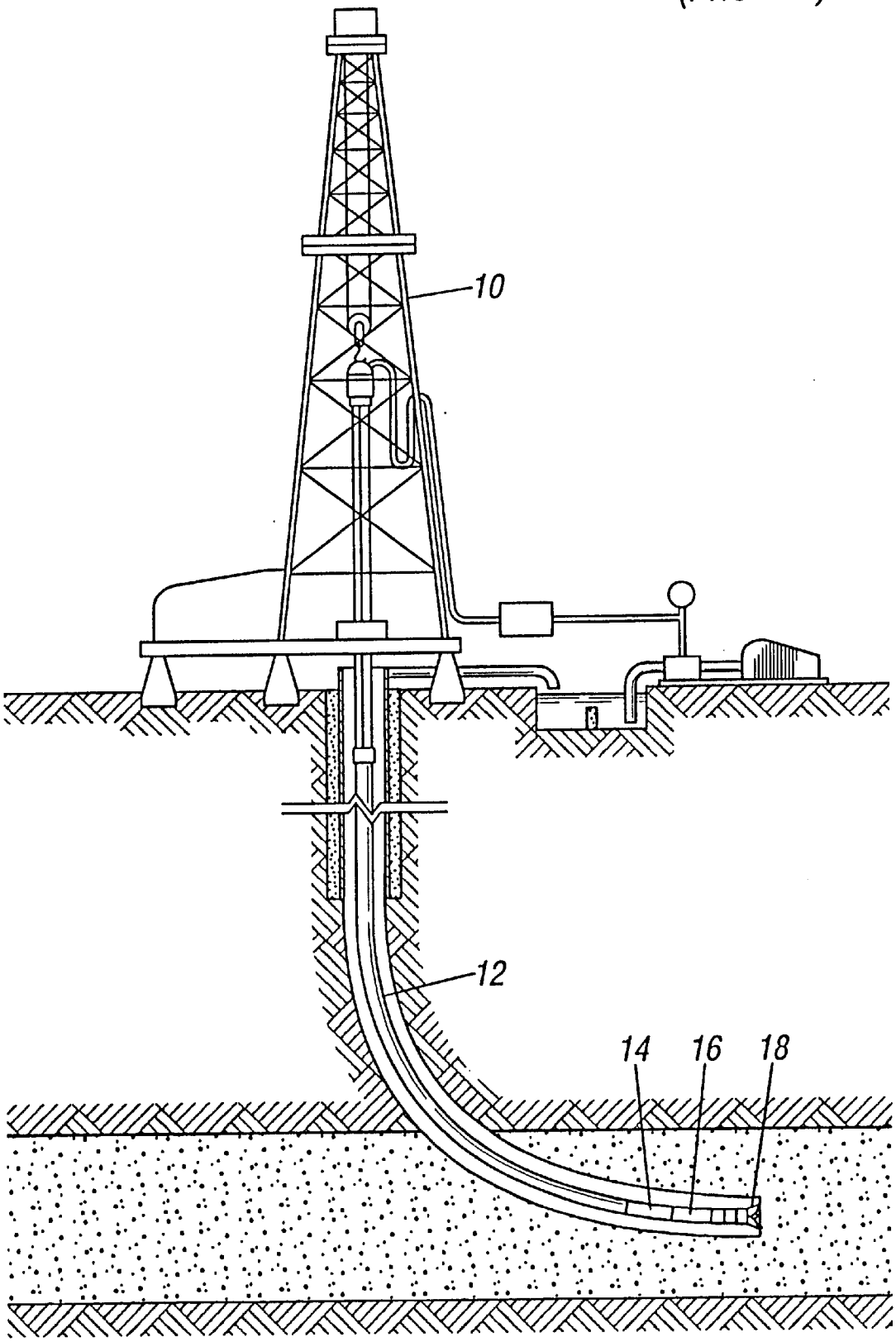
FIG. 1 (Prior Art)
FIG. 1 is a schematic diagram of a downhole steering system constructed in accordance with the prior art.

By combining all of the foregoing factors selectively, such as in the manner disclosed with respect to FIGS. 1–3, a bit that consistently walks right while drilling in the rotating mode, regardless of formation tendencies, can be created. While preferred or specific values for the seven variable features are set forth above, it will be understood that each of the seven features can be implemented to varying degrees to achieve the same results.

Left Hand Walk Bit

Figure 5:
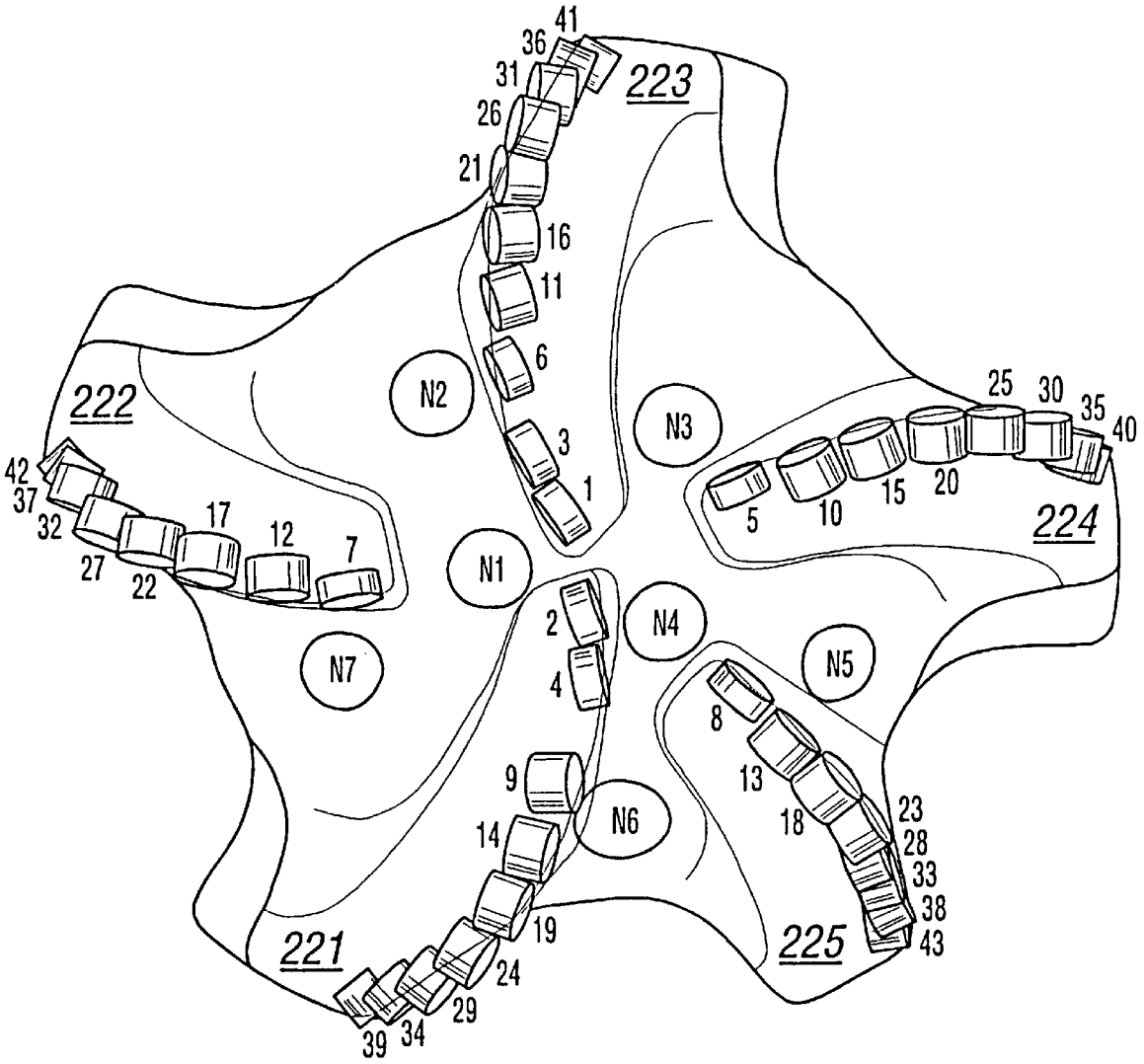
FIG. 5 is a bottom view of a left-hand walking bit constructed in accordance with the principles of the present invention and marked with sequential numbers showing the cutter order.

A bit that consistently walks left can be constructed according to the converse of many of the same principles. It will be recognized by those skilled in the art, however, that left-hand walking bits are easier to construct in general, because left-hand walking follows the natural tendency of a PDC bit under normal operating or drilling conditions. By way of illustration, the left-walking bit 200 shown in FIG. 5, includes blades 221, 222, 223, 224 and 225.

Each of the seven factors described above with respect to right walking bits can be manipulated in combination with one or more of the other factors to produce a bit that predictably walks left, even in those formations that would cause a standard bit to walk right.

What is claimed is:

1. A drill bit adapted to walk predictably during drilling, comprising:

a bit body having a longitudinal axis and a bit face having a nose and an active zone and a passive zone, said active zone and said passive zone lying within the radius of said nose; and a plurality of cutters on said face, a first portion of said cutters being positioned in said active zone and a second portion of said cutters being positioned in said passive zone, said first portion of cutters being more aggressive than said second portion.

2. The walking bit according to claim 1 wherein said bit face includes a plurality of substantially radial blades, at least a portion of one of said blades lies in said passive zone and at least a portion of another of said blades lies in said active zone.

3. The walking bit according to claim 2 wherein said first portion of said cutters has a larger average size than the average size of said second portion of cutters.

4. The walking bit according to claim 1 wherein said first portion of said cutters has a smaller average degree of back rake than the average degree of back rake of said second portion of cutters.

5. The walking bit according to claim 1 wherein said second portion of said cutters includes at least one cutter positioned at a common radius with at least one of said cutters in said first portion.

6. The walking bit according to claim 5 wherein said second portion of said cutters includes at least two cutters positioned at a common radius with at least one of said cutters in said first portion.

7. The walking bit according to claim 1 wherein said bit has an imbalance vector that lies in said active zone.

8. The walking bit according to claim 7 wherein said imbalance vector has a magnitude of 10–25 percent of the weight on bit.

9. A drill bit adapted to walk predictably during drilling, comprising:

a bit body having a longitudinal axis and a bit face having a nose, an active zone and a passive zone, said active zone and said passive zone lying within the radius of said nose; and a plurality of cutters on said face, a first portion of said cutters being positioned in said active zone and a second portion of said cutters being positioned in said passive zone, said first portion of cutters being more aggressive than said second portion;

said bit face including a plurality of substantially radial blades, at least a portion of one of said blades lying in said passive zone and at least a portion of another of said blades lying said active zone, said passive zone blade portion having a secondary cutter tip profile that is steeper toward said bit axis than the cutter tip profile of said active zone blade portion.

10. A drill bit adapted to walk predictably during drilling, comprising:

a bit body having a longitudinal axis and a bit face having a nose, an active zone and a passive zone, said active zone and said passive zone lying within the radius of said nose; and a plurality of cutters on said face, a first portion of said cutters being positioned in said active zone and a second portion of said cutters being positioned in said passive zone, said first portion of cutters being more aggressive than said second portion;

said bit face including a plurality of substantially radial blades, at least a portion of one of said blades lying in said passive zone and at least a portion of another of said blades lying said active zone, said passive zone blade portion having a secondary cutter tip profile that is parallel to but offset from the cutter tip profile of said active zone blade portion.

11. A drill bit adapted to walk predictably during drilling, comprising:

a bit body having a longitudinal axis and a bit face having a nose, an active zone and a passive zone, said active zone and said passive zone living within the radius of said nose; and a plurality of cutters on said face, a first portion of said cutters being positioned in said active zone and a second portion of said cutters being positioned in said passive zone, said first portion of cutters being more aggressive than said second portion;

said bit face including a plurality of substantially radial blades, at least a portion of one of said blades lying in said passive zone and at least a portion of another of said blades lying said active zone, said passive zone blade portion having a gage pad radius that is less than the gage pad radius of said active zone blade.

12. A drill bit adapted to walk right predictably during drilling, comprising:

a bit body having a longitudinal axis and a bit face having a nose and an active zone and a passive zone, said active and passive zones lying within the radius of said nose; and a plurality of cutters on said face, a first portion of said cutters being positioned in said active zone and a second portion of said cutters being positioned in said passive zone said first portion of cutters being more aggressive than said second portion;

the bit having an imbalance force vector that lies in said active zone.

13. The right-walk bit according to claim 12 wherein said bit face includes a plurality of substantially radial blades for supporting said cutters thereon, wherein one of said blades defines a leading edge of said active zone and said imbalance force vector lies proximal said one of said blades.

14. The right-walk bit according to claim 13 wherein the magnitude of said imbalance force is approximately 10–25 percent of the weight on bit.

15. The right-walk bit according to claim 13 wherein the magnitude of said imbalance force is approximately 15 percent of the weight on bit.

16. The right-walk bit according to claim 13 wherein another one of said blades defines a trailing edge of said active zone and the angle between said leading active blade and said trailing active blade is 120–180 degrees.

17. The right-walk bit according to claim 13 wherein one of said blades defines a leading edge of said passive zone another one of said blades defines a trailing edge of said passive zone and the angle between said leading passive blade and said trailing passive blade is approximately 50–90 degrees.

18. The right-walk bit according to claim 17 wherein said first portion of said cutters has a larger average size than the average size of said second portion of cutters.

19. The right-walk bit according to claim 17 wherein said first portion of said cutters has a smaller average degree of back rake than the average degree of back rake of said second portion of cutters.

20. A drill bit adapted to walk right during drilling, comprising:

a bit body having a longitudinal axis and a bit face having an active zone and a passive zone, said bit face including a plurality of substantially radial blades, at least one of said blades lying in said passive zone and at least one of said blades lying in said active zone, said passive zone blade having a secondary profile that is steeper toward said bit axis than is said active zone blade; and and a plurality of cutters on said face, a first portion of said cutters being positioned in said active zone and a second portion of said cutters being positioned in said passive zone, said first portion of cutters having a larger average size than the average size of said second portion of cutters and a smaller average degree of back rake than the average degree of back rake of said second portion of cutters.

21. The right-walk bit according to claim 20 wherein said bit face includes a plurality of substantially radial blades, at least one of said blades lies in said passive zone and at least one of said blades lies in said active zone, and said passive zone blade has a gage pad radius that is less than the gage pad radius of said active zone blade.

22. The right-walk bit according to claim 20 wherein said second portion of said cutters includes at least one cutter positioned at a common radius with at least one of said cutters in said first portion.

23. The right-walk bit according to claim 22 wherein said second portion of said cutters includes at least two cutters positioned at a common radius with at least one of said cutters in said first portion.

24. The right-walk bit according to claim 20 wherein said bit has an imbalance force that lies in said active zone.

25. The right-walk bit according to claim 20 wherein said active zone has a leading edge and said imbalance vector lies in said active zone proximal to said leading edge.

26. The right-walk bit according to claim 20 wherein said active zone spans approximately 120–180 degrees.

27. The right-walk bit according to claim 20 wherein said active zone spans approximately 160 degrees.

28. The right-walk bit according to claim 20 wherein said active zone spans approximately 50–90 degrees.

29. The right-walk bit according to claim 20 wherein said active zone spans approximately 80 degrees.

30. A drill bit adapted to walk right during drilling, comprising:

a bit body having a longitudinal axis and a bit face having an active zone and a passive zone, said bit face including a plurality of substantially radial blades, at least one of said blades lying in said passive zone and at least one of said blades lying in said active zone, said passive zone blade having a secondary profile that contacts the formation less extensively than said active zone blade; and and a plurality of cutters on said face, a first portion of said cutters being positioned in said active zone and a second portion of said cutters being positioned in said passive zone, said first portion of cutters having a larger average size than the average size of said second portion of cutters.

31. The right-walk bit according to claim 30 wherein said bit has an imbalance force that lies in said active zone.

32. A drill bit adapted to walk right during drilling, comprising:

a bit body having a longitudinal axis and a bit face having an active zone and a passive zone, said bit face including a plurality of substantially radial blades, at least one of said blades lying in said passive zone and at least one of said blades lying in said active zone, said passive zone blade having a secondary profile that contacts the formation less extensively than said active zone blade; and and a plurality of cutters on said face, a first portion of said cutters being positioned in said active zone and a second portion of said cutters being positioned in said passive zone, said first portion of cutters having a smaller average degree of back rake than said second portion of cutters.

33. The right-walk bit according to claim 32 wherein said bit has an imbalance force that lies in said active zone.

* * * * *